US008677581B2

(12) United States Patent
Naumann

(10) Patent No.: US 8,677,581 B2
(45) Date of Patent: Mar. 25, 2014

(54) DEEP ROLLING MACHINE FOR CRANKSHAFTS

(75) Inventor: Hans J. Naumann, Albany, NY (US)

(73) Assignee: Hegenscheidt-MFD GmbH & Co. KG, Erkelenz (DE)

( * ) Notice: Subject to any disclaimer, the term of this patent is extended or adjusted under 35 U.S.C. 154(b) by 2443 days.

(21) Appl. No.: 11/522,104

(22) Filed: Sep. 15, 2006

(65) Prior Publication Data

US 2008/0066513 A1 Mar. 20, 2008

(30) Foreign Application Priority Data

Sep. 15, 2006 (DE) ..... 20 2006 014 371 U

(51) Int. Cl.
*B21K 1/08* (2006.01)
*B21D 15/00* (2006.01)

(52) U.S. Cl.
USPC ..... 29/6.01; 72/107

(58) Field of Classification Search
USPC ..... 29/6.01, 888.08; 72/107, 110
See application file for complete search history.

(56) References Cited

U.S. PATENT DOCUMENTS 4,167,106 A * 9/1979 Berstein et al. ..... 72/14.1
5,493,761 A * 2/1996 Bone ..... 29/6.01
5,495,738 A * 3/1996 Gottschalk ..... 72/110
5,943,893 A * 8/1999 Goedderz et al. ..... 72/110
6,393,887 B1 * 5/2002 Steffens et al. ..... 72/110
6,434,992 B1 * 8/2002 Vodopyanov ..... 72/110
6,786,073 B2 * 9/2004 Bone ..... 72/110
2005/0066699 A1 * 3/2005 Bagusche ..... 72/110
2005/0144999 A1 * 7/2005 Heimann ..... 72/110
2005/0223769 A1 * 10/2005 Lonero ..... 72/110

* cited by examiner

*Primary Examiner* — David Bryant
*Assistant Examiner* — Jacob Cigna
(74) *Attorney, Agent, or Firm* — Proskauer Rose LLP

(57) ABSTRACT

The invention regards a deep rolling machine (2) for crankshafts (5) with several deep rolling units (3) in a scissor-type configuration that are attached to the deep rolling machine (2) in the direction of the axis of rotation (4) of the crankshaft (5) with respective lateral distances (6) one besides another in a way that they can swivel thanks to the fact that some deep rolling devices (3) are intended for the deep rolling of main bearing journals (14) and other deep rolling units (3) are intended for the deep rolling of the pin bearing journals of the crankshaft (5) and that the deep rolling units (3) carry at the outer ends of their two scissor-type arms respectively one deep roller head (11) and a supporting roller head (9) that, together, form a deep rolling tool (3) where the deep rolling tool (10) along the scissor-type arms has a distance from the fastening point of the deep rolling unit (3) to the deep rolling machine (2) that is long when compared to the ratio between the width (7) of the scissor-type arms and their length. At least one of the deep rolling units (3) intended for the deep rolling of the main bearing journals (14) or of the pin bearing journals features a device (8) that enters into contact with the crankshaft (5) when the deep rolling unit (3) is in its working position, and that stabilizes the deep rolling unit (3) in the direction of the axis of rotation (4) of the crankshaft (5).

10 Claims, 2 Drawing Sheets

DEEP ROLLING MACHINE FOR CRANKSHAFTS

BACKGROUND OF THE INVENTION

Figure 1:
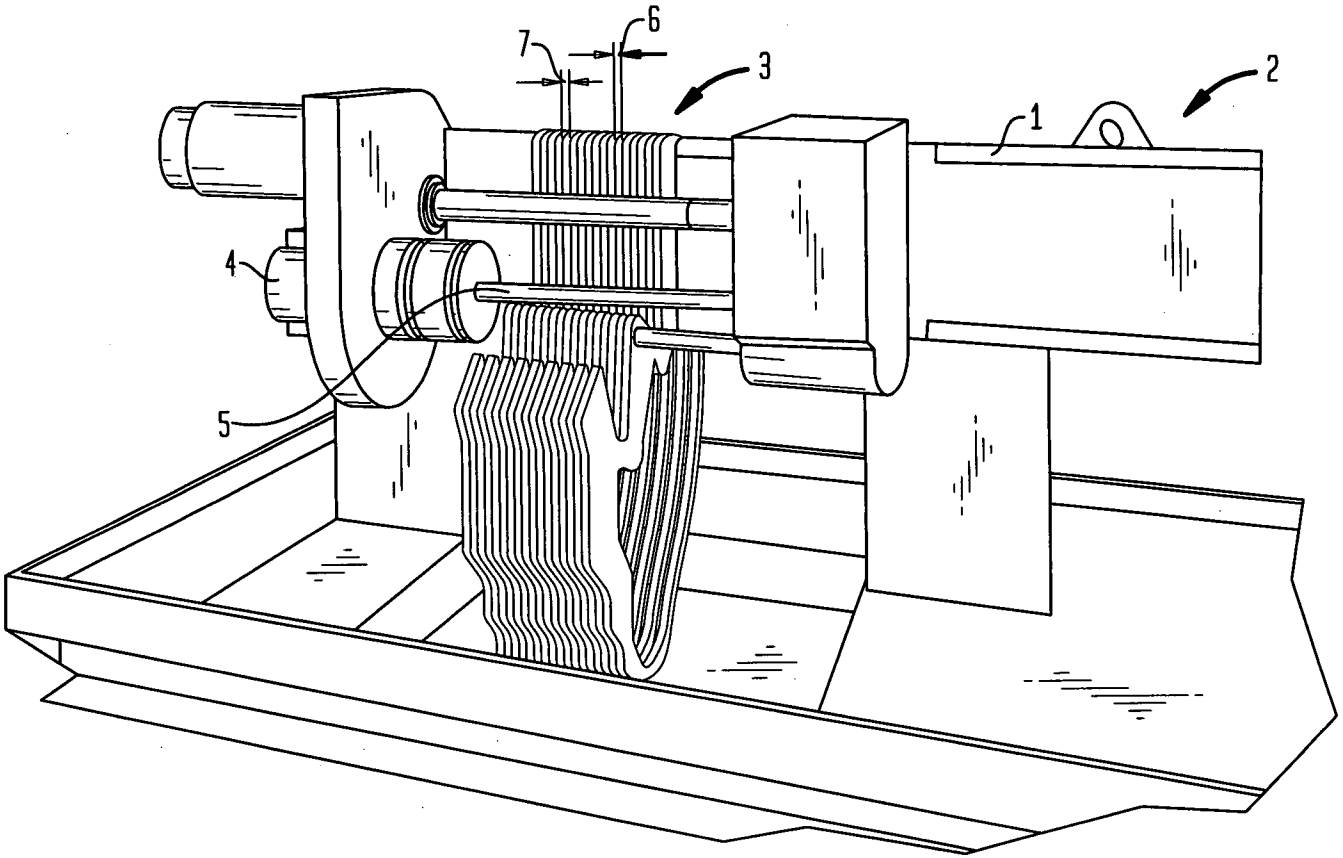

The invention regards a deep rolling machine for crankshafts with several deep rolling units in a scissor-type configuration that are fixed to the deep rolling machine in the direction of the axis of rotation of the crankshaft with lateral distances such that they can be swivelled in a way that some deep rolling units are provided for the deep rolling of main bearing journals and other deep rolling units are provided for the deep rolling of pin bearing journals of the crankshaft, and that the deep rolling units at the exterior ends of their two scissor-type arms carry respectively a deep rolling head and a supporting roller head that, together, form a deep rolling tool, where the deep rolling tool along the scissor-type arms has a large distance from the relative fastening of the deep rolling unit that is proportionate to the width of the scissor-type arms and their length.

Deep rolling machines of this specific type with deep rolling units in a scissor-type configuration are known for example from patent EP 0 881 041 B1. A deep rolling machine that employs deep rolling units in a scissor-type configuration is furthermore the object of the preceding German Patent Application 10 2005 014 998.7-14 by this applicant.

The deep rolling units in a scissor-type construction have the distinctive feature that the deep rolling tool has along the scissor-type arms a large distance from the fastening point of the deep rolling unit on the deep rolling machine that is proportionate to the relation between the width and the length of the scissor-type arms. The result is that the deep rolling unit has a rather low stability in the direction of the of rotation axis of the crankshaft rotating in the deep rolling machine. If there are provided several deep rolling units, which is the case on modern deep rolling machines for crankshafts, it is possible that undesired movements like axial vibrations occur during the deep rolling process which are then transmitted to all deep rolling units. Accordingly, such vibrations lead to a deterioration in the machining result.

From this, it is an object of the present invention to provide a device on the deep rolling machine that stabilises the deep rolling units along the axis of rotation of the crankshaft during the deep rolling process. A further object is, that the device is to be of a simple design and shall not negatively affect the functioning of the deep rolling units but on the contrary, even improve it.

The solution that was found is that the deep rolling units can be stabilised in the axial direction if at least one of the deep rolling units intended for the deep rolling of the main bearing journals or of the pin bearing journals features a device that grips the crankshaft in the working position of the deep rolling unit and stabilises the deep rolling unit in the direction of the crankshaft's axis of rotation.

In the most simple case, such a device comprises an axial guide roller that is fastened to the supporting roller head and engages between the relative oil collars of a bearing journals of the crankshaft. An axial guide roller attached to the supporting roller head is for example known from the patent EP 1 112 146 B1. This axial guide roller is intended to prevent the contact between the deep rollers or the supporting rollers and the oil collars of the crankshafts while the deep rolling tools close.

Another axial guide roller attached to the deep rolling head is also known from German Patent DE 103 61 738 B3. This known device has as an object to form a guiding device that is able to absorb forces in axial direction that are transmitted or caused by the deep rolling tool. The advantage in the functioning of the known device is that an axial guide roller arranged firmly on the deep rolling head that limits an axial movement of the deep rolling unit in the longitudinal direction along the axis of rotation of the crankshaft can transmit forces that point to the same direction to the oil collars of the crankshaft. In the context of the known device, the intention was rather to introduce different deep rolling forces, which can arise on the deep rolling rollers, into the crankshaft (compare FIGS. 6 and 7). However, the idea to stabilise the sum of all deep rolling units in axial direction and to suppress any vibrations was not yet subject of the known device. In particular, it had not yet been understood that an axial guide roller that is attached to the supporting roller head as is known from the above-mentioned EP 1 112 146 has a stabilising effect on the other deep rolling units of a deep rolling machine.

From patent EP 1 469 972 B1, an axial guide element is known that is shaped as a prismatic sliding body. This known device is also attached to the supporting roller head and acts between the oil collars of a bearing journal of a crankshaft when the deep rolling tool is closed. In the context of the known device, it is also known that due to the scissor-type configuration of the deep rolling unit, the axial alignment simultaneously assumes also the guidance of the deep rolling head in axial direction of the crankshaft.

Another configuration of the present invention provides further devices for the stabilisation of the deep rolling units along the scissor-type arms of the deep rolling units. It is preferable to arrange such devices between an exterior end of the scissor-type arm and the pivot of the scissors formed by the scissor-type arms and to let them attack the crankshaft from there. Such devices may preferably be distance pieces or distance holders that ensure on the one hand the mutual distance between the deep rolling tools and on the other hand the attack to the crankshaft. Such a solution is in particular of interest if complicated crankshafts need to be machined, for example split-pin crankshafts, where no axial guide roller can be mounted onto the deep roller head or onto the support roller head for reasons of space.

DETAILED DESCRIPTION

The invention will now be specified in greater detail by describing an embodiment thereof. It shows:

FIG. 1 with a deep rolling machine in a perspective view and

Figure 2:
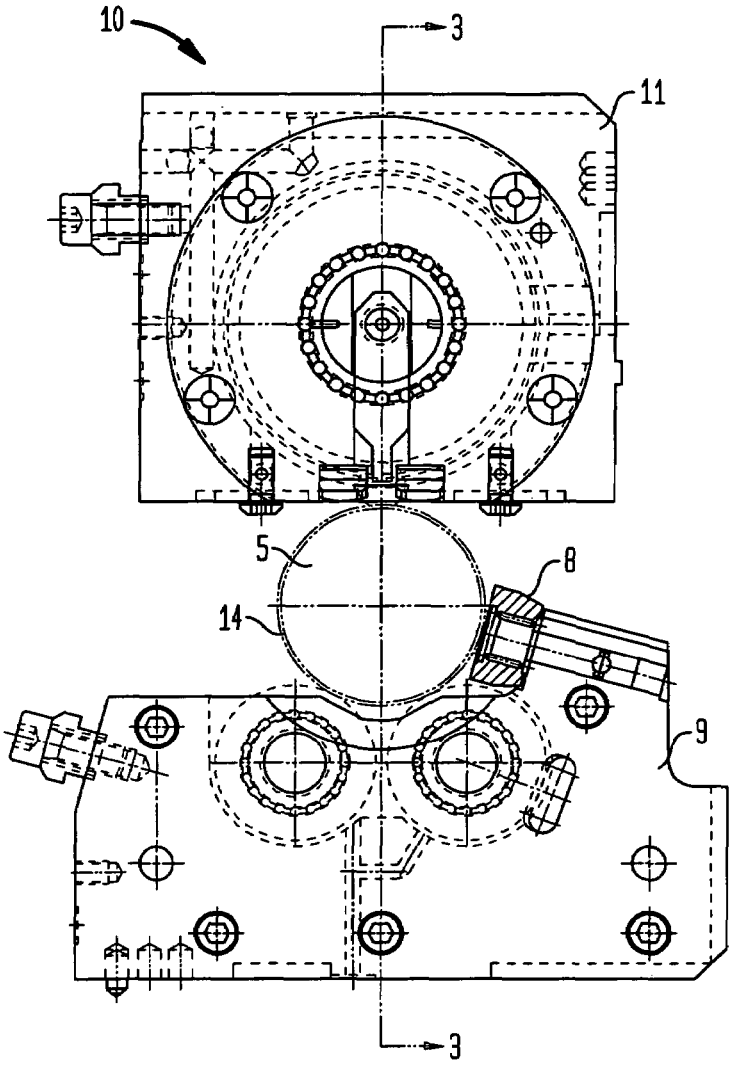

FIG. 2 with a deep rolling tool in a lateral view, and

Figure 3:
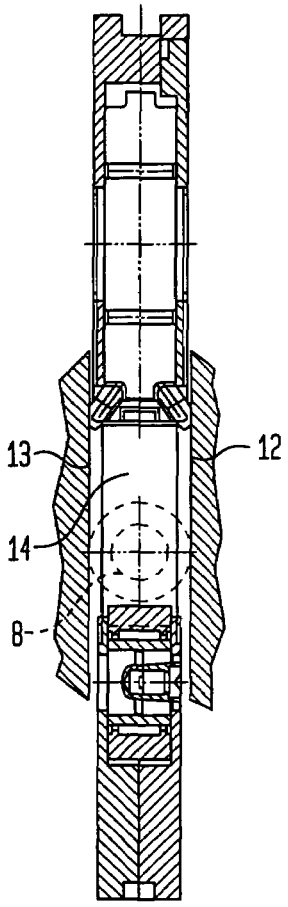

FIG. 3 with a section across the deep rolling tool from FIG. 2 along the line III-III.

On a crossbeam 1 of the deep rolling machine 2, there are several deep rolling units 3 arranged side by side. The deep rolling units 3 are designed as of the scissor-type and are attached to the crossbeam 1 along the axis of rotation 4 of a crankshaft 5 clamped in the deep rolling machine 2 and have the mutual distance 6. The deep rolling units 3 have respectively a width of 7 that is small when compared to their length. The result is that the deep rolling units 3 have a low bending resistance in the direction of the axis of rotation 4. This low bending resistance results in the potential that during the deep rolling of the crankshaft 5, vibrations can result in the deep rolling machine 2 that point in the axial direction 4 and can affect all deep rolling units 3.

To prevent such vibrations, an axial roller 8 is provided that is pivoted on the supporting roller head 9 of the deep rolling tool 10. If the deep rolling tool 10 which comprises the deep rolling head 11 and the supporting roller head 9 as shown in FIG. 2 is closed, the axial guide roller 8 enters into contact with the relative oil collars 12 and 13 of a bearing pin 14 of the crankshaft 5. With this intervention, the axial guide roller 8 stabilises the appertaining deep rolling unit 3 in the axial direction 4 and transmits the forces that may occur on the deep rolling unit 3 between the fixation on the crossbeam 1 and the deep rolling tool 10, at the exterior end of the scissor-type arms of the deep rolling unit 3 to the crankshaft 5 and in this way, it stabilises the appertaining deep rolling unit 3. Such forces can arise due to vibrations that form in axial direction on one of the deep rolling units 2 due to different forces.

It is sufficient to stabilise single deep rolling units 3 of a deep rolling machine 2 in the direction of the axis of rotation 4. This can for example be done by means of one or several deep rolling units 10 that attack the main bearing journals 14 of the crankshaft 5 or one or several deep rolling tools 10 that attack the pin bearing journals of the crankshaft 5. However, it has been widely adopted to equip all deep rolling units 3 on a deep rolling machine 2 with devices that stabilise the deep rolling units 3 in axial direction 4.

The other configuration in the context of the present invention is not shown here graphically where stabilising devices can be mounted between individual deep rolling units 3 at a mutual distance 6. These may be spacer pieces or distance holders that attack a bearing journal 14 on a crankshaft 5 from a point of the scissor-type arms of the deep rolling unit 3. Preferred locations for the installation of such stabilisers are for example hinge points on the scissors arms of the deep rolling units 3.

LIST OF REFERENCE MARKS

1 Crossbeam
2 Deep rolling machine
3 Deep rolling unit
4 Axis of rotation
5 Crankshaft
6 Mutual distance
7 Width
8 Axial guide roller
9 Supporting roller head
10 Deep rolling tool
11 Deep rolling head
12 Oil collar
13 Oil collar
14 Main bearing journal

The invention claimed is:

1. A deep rolling machine for crankshafts with several deep rolling units in a scissor-type configuration which are with lateral distances one next to another hinged to the deep rolling machine in the direction of the axis of rotation of the crankshaft, so that some deep rolling units are provided for the deep rolling of the main bearing journals and other deep rolling units for the deep rolling of the pin bearing journals of the crankshaft and the deep rolling units at the outer ends of their two scissor-type arms carry a deep rolling head and a supporting roller head respectively that form together a deep rolling tool where the deep rolling units have respectively a width that is small when compared to their length, wherein at least one of the deep rolling units intended for the deep rolling of the main bearing journals or of the pin bearing journals features a device that attacks the crankshaft when the at least one of the deep rolling units is in its working position and that stabilises the deep rolling units in the direction of the axis of rotation of the crankshaft.

2. The deep rolling machine according to claim 1, wherein the device for stabilising the deep rolling units suppresses vibration of the deep rolling units.

3. The deep rolling machine according to claim 1, wherein the device for stabilising the deep rolling units is arranged between an exterior end of the scissor-type arms of the at least one of the deep rolling units and a pivot of the scissors formed by the scissor-type arms.

4. The deep rolling machine according to claim 3, wherein the device for stabilising the deep rolling units is located on a hinge point of the at least one of the deep rolling units.

5. The deep rolling machine according to claim 4, wherein the device for stabilising the deep rolling units is designed as distance holder or spacer piece.

6. The deep rolling machine according to claim 1, wherein the device for stabilising the deep rolling units is located on the deep rolling tool.

7. The deep rolling machine according to claim 6, wherein the device for stabilising the deep rolling units is designed as an axial guide roller that acts on the oil collars of a main bearing journal or of a pin bearing journal of the crankshaft.

8. The deep rolling machine according to claim 6, wherein the device for stabilising the deep rolling units is shaped as a prismatic slide block that acts between the appertaining oil collars of a main bearing journal or of a pin bearing journal of the crankshaft when the at least one of the deep rolling units is in working position.

9. The deep rolling machine according to claim 6, wherein the device for stabilising the deep rolling units is located on the deep rolling head of the deep rolling tool.

10. The deep rolling machine according to claim 9, wherein the device for stabilising the deep rolling units is located on the supporting roller head.

* * * * *